United States Patent [19]

Brisken et al.

[11] 4,411,715

[45] Oct. 25, 1983

[54] METHOD OF ENHANCING ROTOR BORE CYCLIC LIFE

[75] Inventors: Thomas A. Brisken, Cincinnati; Alexander G. Maier, Forest Park, both of Ohio

[73] Assignee: The United States of America as represented by the Secretary of the Air Force, Washington, D.C.

[21] Appl. No.: 270,051

[22] Filed: Jun. 3, 1981

[51] Int. Cl.[3] ..... C21D 9/00

[52] U.S. Cl. ..... 148/131; 148/154; 148/155

[58] Field of Search ..... 148/154, 131, 155, 13, 148/134

[56] References Cited

U.S. PATENT DOCUMENTS

| | | | |
|---|---|---|---|
| 3,970,412 | 7/1976 | Sundt | 416/219 R |
| 4,005,515 | 2/1977 | Sundt | 29/156.8 R |
| 4,086,690 | 5/1978 | Bernasconi | 29/156.8 R |

*Primary Examiner*—R. Dean

*Attorney, Agent, or Firm*—Donald J. Singer; Jacob N. Erlich

[57] ABSTRACT

A method of enhancing or prolonging the low cycle fatigue life of the bore area of a rotating disk. The method comprises the step of prestressing the bore area by heating the web/rim area of the disk, while moderately overspeeding the disk. The heating can be accomplished with the use of induction heating coils which are disposed adjacent the web/rim area of the disk. This method, unlike prior art prestressing methods, is simple to perform, is cost effective, and does not compromise the disk or the design of the assembly of which the disk is a component.

9 Claims, 5 Drawing Figures

METHOD OF ENHANCING ROTOR BORE CYCLIC LIFE

STATEMENT OF GOVERNMENT INTEREST

The invention described herein may be manufactured and used by or for the Government for governmental purposes without the payment of any royalty thereon.

BACKGROUND OF THE INVENTION

This invention relates generally to the low cycle fatigue life of the bore area of a rotating disk and, more particularly, to a novel method of enhancing (i.e., extending) said life.

In some applications (such as are in use in advanced, high tip-speed, gas turbine engines), the bore area of a rotating disk is subjected to exceptionally high stresses. The result is that such a bore area can become low cycle fatigue life limiting to the same extent as stress concentration areas, such as bolt holes, dovetails, rabbets, and the like. In a gas turbine engine, the consequence of failure of a bore area of the rotating disk is far more severe than a failure in the web/rim area of the rotating disk. For example, in an aircraft engine of the gas turbine type, the failure of the bore area in a high pressure turbine disk would result in the release of 100 times the amount of kinetic energy that would be released if a single post (with 2 blades) in the rim area of the same disk failed. It is imperative, therefore, to have additional margin in the low cycle fatigue life of the bore area of a rotating disk.

The concept of prestressing the bore area of a rotating disk to improve low cycle fatigue life is not new. Some of the prior art methods include: conventional overspeed; mandrel expansion of the bore by differential heating/cooling (i.e., uniform heating of the disk and cooling of the mandrel); the use of an interference fit bore sleeve; and the use of an interference fit bore sleeve plus bore prestress. All of the prior art methods have some inherent disadvantages, such as being complex, costly, and compromising the disk and/or the turbomachine (e.g., the engine) design. For example, conventional overspeeding of the disk will induce some desired residual compressive stress in the bore area, but it will also give an undesirable level of residual tensile stress in the rim area.

It is, therefore, readily apparent that what is needed in the art, and is not currently available, is a method of enhancing the low cycle fatigue life of the bore area of a rotating disk without any of the inherent disadvantages of the prior art methods.

SUMMARY OF THE INVENTION

The instant invention enhances the low cycle fatigue life of the bore area of a rotating disk without any of the inherent disadvantages of prior art methods. The invention, therefore, constitutes a significant advance in the state of the art. The instant invention method eliminates the prior art disadvantages, and yet attains the desired results, by comprising the step of prestressing the bore area by heating the web/rim area of the disk, while moderately overspeeding the disk (i.e., from approximately 15,000 rpm to approximately 19,000 rpm).

Accordingly, it is an object of this invention to provide a method of prestressing the bore area of a rotating disk which, unlike the prior art conventional overspeed method, is capable of obtaining significant bore area residual compressive stress without inducing significant residual tensile stress in the rim area of the disk.

It is another object of this invention to provide a cost-effective method of prestressing the bore area of a rotating disk, e.g., a method which does not require mandrel dies, does not require expansion dies, does not require machining after prestressing, and the like.

It is still another object of this invention to provide a method of prestressing the bore area of a rotating disk which can be applied to existing designs without necessitating design changes.

It is a further object of this invention to provide a method of prestressing the bore area of a rotating disk whereby the residual compressive stresses attained in the bore area are technologically preferable to the stresses attained by mechanical expansion. More specifically, the heated overspeeding step of the instant inventive method acts directly on the maximum stress location in the bore area, i.e., at the bore center, whereas the mandrel expansion method acts on the sides of the bore area.

These objects of this invention, as well as other objects related thereto (such as simplicity of the inventive method), will become readily apparent after a consideration of the description of the invention, together with reference to the contents of the Figures of the drawings.

DESCRIPTION OF THE DRAWING

FIG. 2A shows, in effect, the practice of the inventive method on a representative rotating disk; whereas.

DESCRIPTION OF THE INVENTIVE METHOD

As a preliminary matter, and with reference to FIG. 1, it is to be noted that the instant invention is useable with any rotating disk, and that for illustrative reasons, and not because of any limitation, the invention will be described as used with a rotor disk 10 in the high pressure turbine section 110 of an aircraft engine 100 of the gas turbine type (i.e., in this case it is a turbofan engine).

Figure 1:
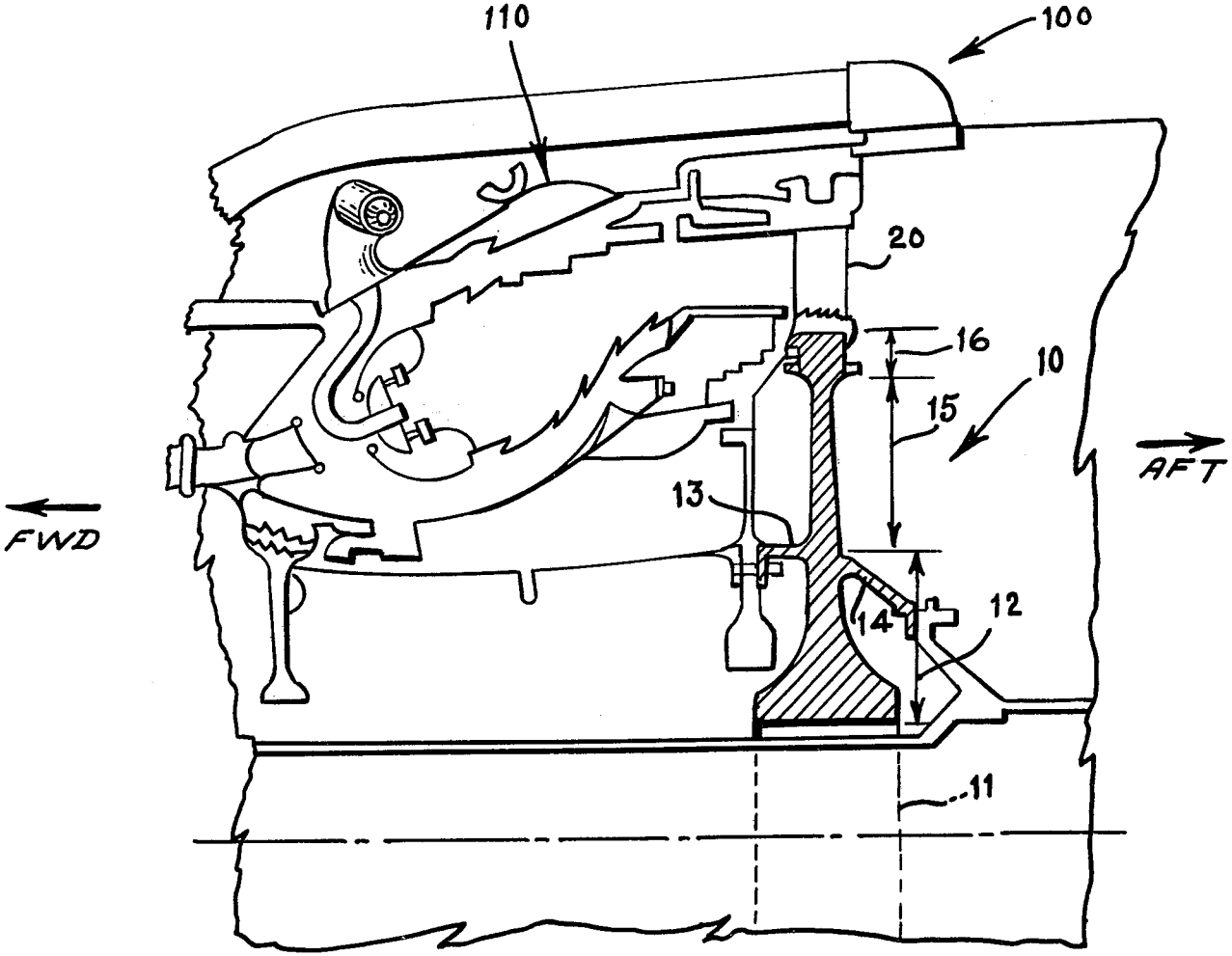
FIG. 1 is a side elevation view, in simplified schematic and pictorial form, partially in cross section and partially fragmented, showing the result of the use of the instant invention in a typical working environment, i.e., in the high pressure turbine section of an aircraft engine of the gas turbine type.

Still with reference to FIG. 1, the rotor or rotating disc 10 (of which only the upper half is shown in FIG. 1 to maintain an unencumbered drawing) has a bore hole 11, a bore area 12, a forward flange 13, an aft flange 14, a web area 15, and a rim area 16 at the periphery of which are attached, in a circumferential spaced apart relationship, a plurality of rotor blades 20. The disk 10 is attached to the rotor structure assembly at the forward and aft flanges 13 and 14, as shown in FIG. 1.

The instant invention is a novel method of enhancing (i.e., extending or prolonging) the low cycle fatigue life of the bore area 12 of a rotating disk 10, and thereby enhancing the useful life of the disk 10 itself.

Figure 2A:
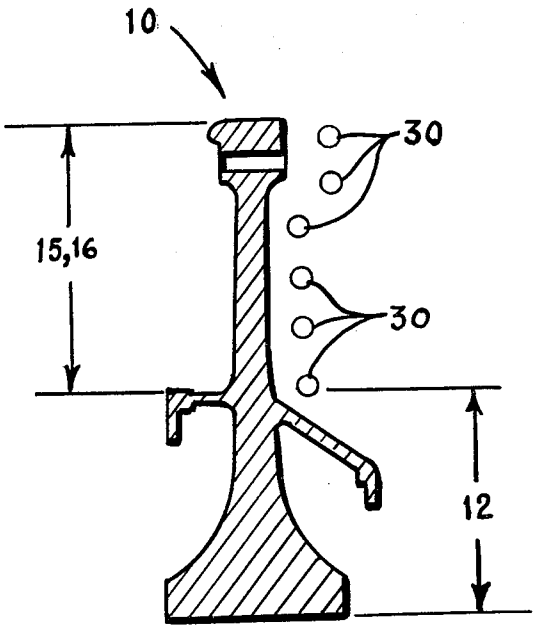
Figure 2B:
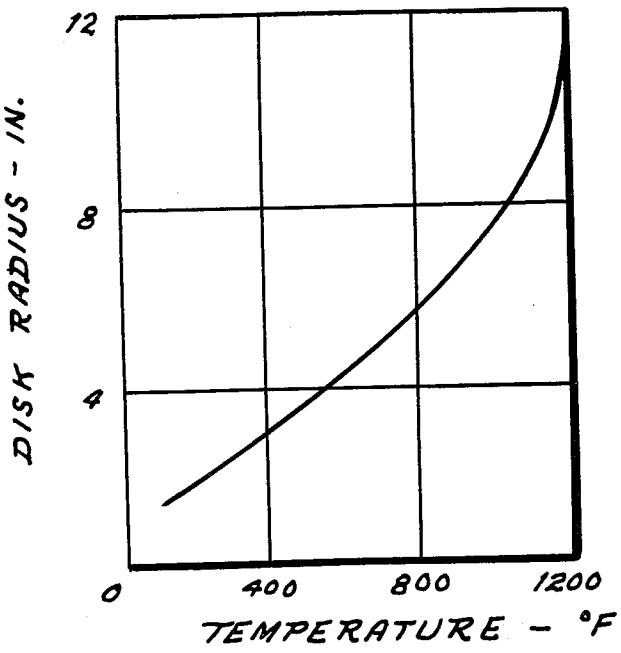
FIG. 2B shows in graph form what is occurring during the practice of the inventive method on the representative rotating disk.
Figure 3:
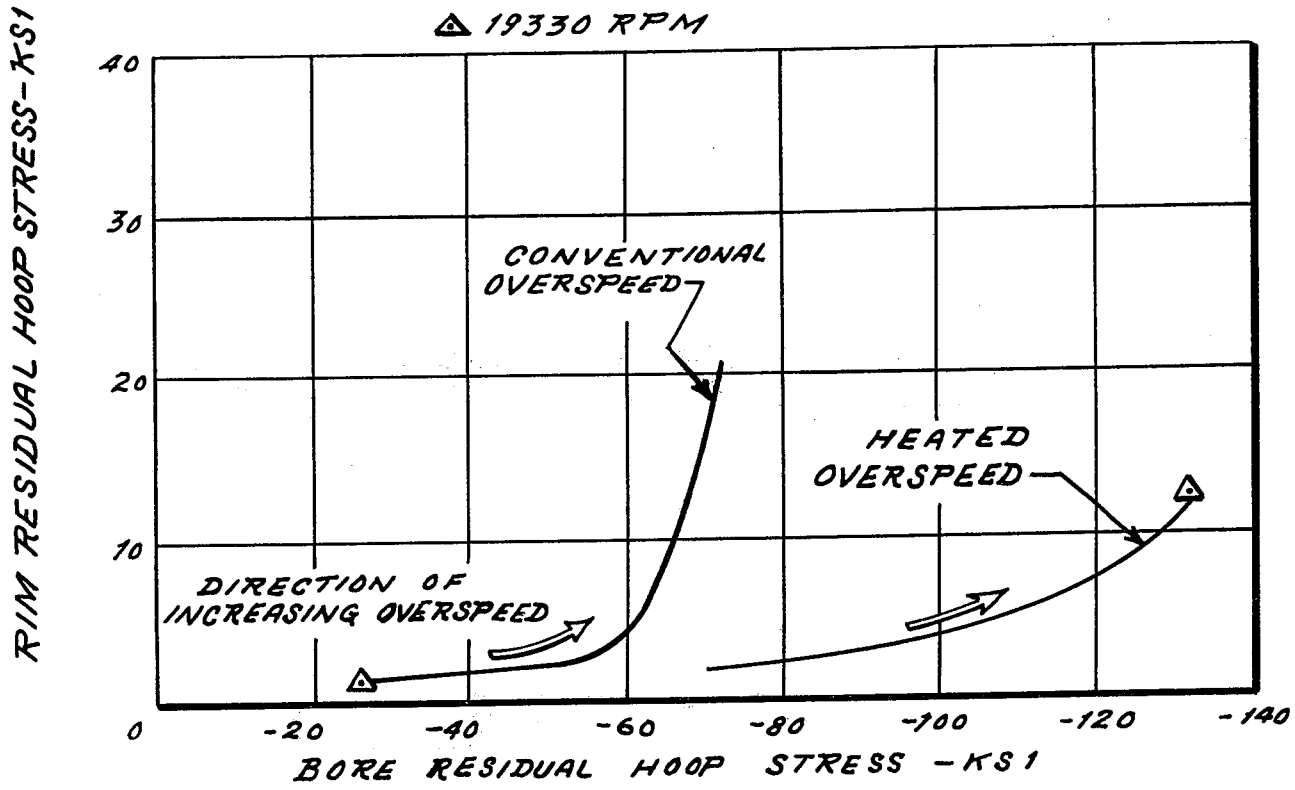
FIG. 3 shows in graph form the difference in residual hoop stress in the rim area of a rotating disk after prestressing by conventional overspeed, as compared to the same stress in the bore area of an identical rotating disk after prestressing by the instant inventive method (i.e., heated overspeed)

With reference to FIGS. 1 and 2A, the fundamental and unique step of the instant inventive method comprises prestressing the bore area 12 of the disk 10 by heating the web/rim area 15, 16 of the disk 10, while moderately overspeeding the disk 10 from approximately 15,000 rpm to approximately 19,000 rpm. As shown in FIG. 2A, the heating of the web/rim area 15, 16 preferably is accomplished by the use of induction heating coils 30, FIG. 2. The heating is continued until the web/rim area 15, 16 is up to temperature (i.e., to 1200 degrees Fahrenheit in this case, as is shown in FIG. 2B).

MANNER OF USE OF THE INVENTIVE METHOD

The inventive method can be used to enhance the low cycle fatigue life of the bore area of any rotating disk, and thereby prolong the useful life of the rotating disk itself.

As will be correctly concluded by any person of ordinary skill in the art, the instant invention is based upon our novel finding and discovery that it is only when the web/rim area 15, 16 is heated that large compressive stresses can be obtained in the bore area 12 of a disk 10. This is because the thermal gradient from the disk bore area 12 to the rim area 16 adds a component of tensile stress in the bore area 12 during overspeed, while subtracting stress in the rim area 16. Thus, the bore area 12 is forced to yield at a lower speed, and a speed at which the rim area 16 is relatively unaffected, such that, after yielding, the bore area 12 goes into compression.

Figure 4:
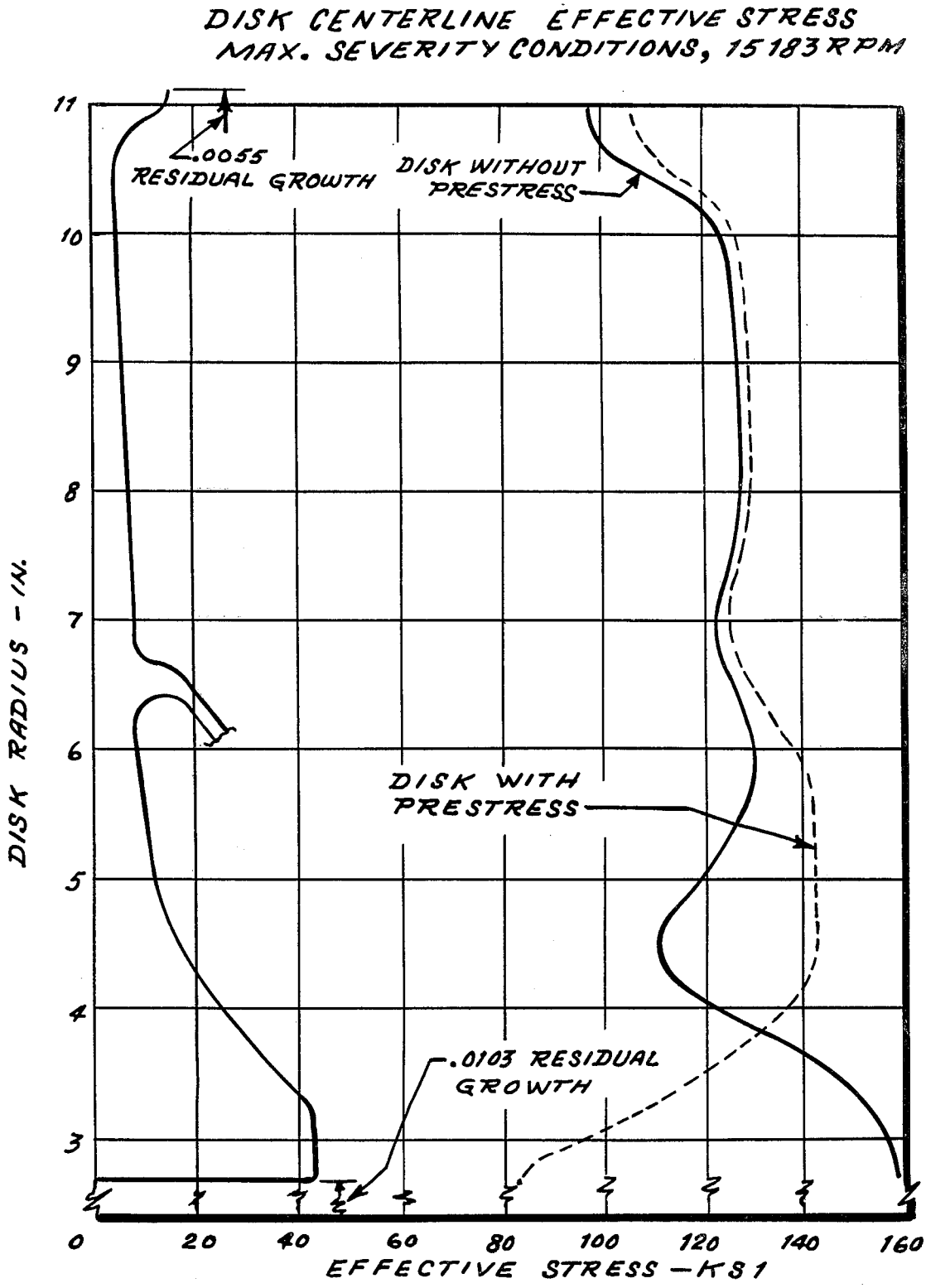
FIG. 4 shows in graph form the difference in stress distribution in the rotating disk at design conditions with, and without, the beneficial effects of the instant inventive method (i.e., heated overspeed prestress). The pertinent portion of the disk is superimposed on the graph to better orient the reader.

Attention is invited to FIG. 4, wherein the stress distribution in the disk at the design condition with, and without, the beneficial effects of a heated overspeed prestress are compared in graph form. It is to be noted from FIG. 4 that maximum effective stress for the prestressed disk is shown to be one-half that of the conventional, unprestressed disk in the bore area.

Additionally, uniaxial testing on prestressed bars has shown a life improvement of up to twenty times that of standard test specimens.

It is abundantly clear from all of the foregoing, and from the contents of the Figures of the drawing, that the stated objects of the inventive method, as well as other objects related thereto, have been achieved.

It is to be noted that, because of our teachings herein, it may occur to others of ordinary skill in the art that, in appropriate particular circumstances, the fundamental and unique step of the inventive method can be increased, and if increased, then can be varied in sequence, but only semantically. In this regard it is also to be noted that, in spite of any variations in the number (and, if applicable, in the sequence) of the fundamental and unique step of the inventive methods, the same desired result (i.e., the enhancement or prolonging of the low cycle fatigue life of the bore area of a rotating disk) is to be expected and in fact will be obtained. For example, the steps semantically can be extended to three steps, instead of one, e.g., overspeeding the disk, heating the web/rim area of the disk during the overspeeding, and discontinuing the overspeeding and the heating when the desired temperature of the web/rim area has been attained:

What is claimed is:

1. A method of enhancing the low cycle fatigue life of the bore area of a rotating disk wherein said disk also has a web/rim area with a rim area portion, comprising the step of prestressing said bore area by heating said web/rim area of said disk, while not heating said bore area of said disk, and while moderately overspeeding said disk, whereby a thermal gradient is applied to said disk rim area portion of said web/rim area, thereby adding a tensile stress in said bore area of said disk and subtracting stress in said rim area portion of said web/rim area of said disk.

2. A method of enhancing the low cycle fatigue life of the bore area of a rotating disk, as set forth in claim 1, wherein said heating of said web/rim area of said disk is accomplished with the use of induction heating coils disposed adjacent to said web/rim area of said disk.

3. A method of enhancing the low cycle fatigue life of the bore area of a rotating disk, as set forth in claim 2, wherein said overspeeding is at the rate of approximately 19,000 rotations per minute.

4. A method of enhancing the low cycle fatigue life of the bore area of a rotating disk, as set forth in claim 2, wherein said rotating disk is a rotor of a turbine.

5. A method of enhancing the low cycle fatigue life of the bore area of a turbine rotor disk, as set forth in claim 4, wherein said turbine rotor disk is in the turbine section of a gas turbomachine.

6. A method of enhancing the low cycle fatigue life of the bore area of a turbine rotor disk, as set forth in claim 5, wherein said gas turbomachine is a gas turbine aircraft engine.

7. A method of enhancing the low cycle fatigue life of the bore area of a turbine rotor disk, as set forth in claim 6, wherein said gas turbine aircraft engine is a turbofan engine.

8. A method of enhancing the low cycle fatigue life of the bore area of a turbine rotor disk, as set forth in claim 7, wherein said turbine rotor disk is located in the high pressure turbine section of said turbofan engine.

9. A method of enhancing the low cycle fatigue life of the bore area of a high pressure turbine rotor disk, as set forth in claim 8, where said disk has a radius of 12 inches, and said web/rim area of said disk is heated to a temperature of 1200 degrees Fahrenheit.

* * * * *